US005395222A

United States Patent [19]

Kawahara et al.

[11] Patent Number: 5,395,222

[45] Date of Patent: Mar. 7, 1995

[54] SCROLL COMPRESSOR HAVING RECESSES ON THE SCROLL WRAPS

[75] Inventors: Sadao Kawahara, Otsu; Michio Yamamura, Kusatsu; Jiro Yuda, Ikoma; Yoshinori Kojima, Kusatsu; Shuichi Yamamoto, Otsu; Manabu Sakai, Toyonaka; Shigeru Muramatsu; Osamu Aiba, both of Kusatsu, all of Japan

[73] Assignee: Matsushita Electric Industrial Co., Ltd., Osaka, Japan

[21] Appl. No.: 720,482

[22] PCT Filed: Nov. 2, 1990

[86] PCT No.: PCT/JP90/01425

§ 371 Date: Sep. 3, 1991

§ 102(e) Date: Sep. 3, 1991

[87] PCT Pub. No.: WO91/06777

PCT Pub. Date: May 16, 1991

[30] Foreign Application Priority Data

Nov. 2, 1989 [JP] Japan ..... 1-287023

[51] Int. Cl.[6] ..... F04C 1804

[52] U.S. Cl. ..... 418/55.2

[58] Field of Search ..... 418/55.2

[56] References Cited

U.S. PATENT DOCUMENTS 4,997,348 3/1991 Kolb et al. ..... 418/55.2

FOREIGN PATENT DOCUMENTS 0318189 5/1989 European Pat. Off. .
61-265376 11/1986 Japan .
62-263982 11/1987 Japan .
01163401 6/1989 Japan .
01170779 7/1989 Japan .
01177482 7/1989 Japan .
2149857 6/1985 United Kingdom ..... 418/55.2

*Primary Examiner*—John J. Vrablik
*Attorney, Agent, or Firm*—Stevens, Davis, Miller & Mosher

[57] ABSTRACT

A recess is provided in the wrap of a stationary scroll in the vicinity of a terminal end thereof on the side of a suction chamber, so that an orbital scroll can be prevented from collision against the stationary scroll, thereby avoiding breakage of both scroll wraps and occurrence of noises. Further, with the provision of another recess in the orbital scroll wrap in the vicinity of a terminal end thereof, the orbital scroll can be prevented from colliding against the stationary scroll, thereby preventing breakage of both scroll wraps and occurrence of noises.

3 Claims, 3 Drawing Sheets

SCROLL COMPRESSOR HAVING RECESSES ON THE SCROLL WRAPS

TECHNICAL FIELD

The present invention relates to a scroll-type compressor.

BACKGROUND ART

As publicly known, a scroll compressor has been known such that a suction chamber is at an outer peripheral portion of the compressor, a discharge port is provided at a central portion of a swirl or scroll, and fluid is successively compressed through two symmetrical scroll compression spaces, which join each other at the discharge port, from the outer peripheral portion of the compressor toward a compression chamber defined at the center thereof. The structure of a conventional scroll compressor is illustrated in FIGS. 1 and 4. There are provided a scroll compressor 2 and a motor 3 in a sealed container 1. The scroll compressor 2 mainly comprises a stationary scroll 4, an orbital scroll 5, a self-rotation prevention mechanism 6, a crank shaft 7, a frame 8, and a bearing 9. The stationary scroll 4 has a scroll wrap 11 which stands upright on an end plate 10. As conventionally known, the wrap 11 is configured with a curved line which is made up of an involute curve and a circular arc combined, or the like shape. Also, the stationary scroll 4 is provided with a suction port 12 for sucking gas to be compressed at its outer periphery, a suction chamber 13 in communication with the suction port 12, and a discharge port 14 at a central portion thereof. On the other hand, the orbital scroll 5 has an end plate 15 and a scroll wrap 16 standing upright thereon. The configurations of the respective wraps 11 and 16 of the stationary scroll 4 and the orbital scroll 5 are in plane-symmetry relation and offset or deviated from each other by an angle of 180°. Further, because the stationary scroll 4 and the orbital scroll 5 are meshingly engaged with each other with the centers of the scrolls deviated from each other by a length of a radius of an orbiting movement of the latter, the two wraps 11 and 16 are in contact with or in a condition of being closest to each other (represented as "contact", hereinafter) at a plurality of positions so that a plurality of compression chambers 17 are defined. The orbital scroll 5 has a boss portion 18 on its rear surface, into which the crank shaft 7 is inserted. The self-rotation prevention mechanism 6 is arranged between the rear surface of the orbital scroll 5 and the frame 8. The crank shaft 7 is supported by the frame 8 via the bearing 9. A rotor of the motor 3 is fixed to one end of the crank shaft 7 and the other end thereof is inserted into the boss portion 18 of the orbital scroll 5. With the above-described arrangement, when the crank shaft 7 rotates by the driving of the motor 3, the orbital scroll 5 makes an orbiting movement with respect to the stationary scroll 4, maintaining its posture as it is by the function of the self-rotation prevention mechanism. Then, the compression chambers 17 defined by the stationary scroll 4 and the orbital scroll 5 engaged with each other gradually move from the outer peripheral portions of the scrolls to the central portion thereof owing to the orbiting movement of the orbital scroll 5 so that the volume of each compression chamber is decreased. As a result, low-pressure gas sucked from the suction port 12 flows through the suction chamber 13, is compressed in the above process and is discharged from the discharge port 14 of the scroll compressor 2 into the sealed container 1. After that, the high-pressure gas in the sealed container 1 is delivered through a discharge pipe 19 to the outside of the compressor.

FIG. 1 shows a plane view of the both scroll wraps. Compression is started after the orbital scroll 5 which makes the orbiting movement has been in contact with terminal ends 11*a* and 11*b* of the stationary scroll wrap 11. A distance or gap between the both scroll wraps in a radial direction thereof is set at zero or a very small value in order to provide a good seal between them. In other words, the orbital scroll 5 orbits while colliding against the terminal end 11*a* of the stationary scroll wrap. This collision may bring about destruction of the both scroll wraps or may cause noises. The orbital scroll 5 makes its orbiting movement while also colliding against the terminal end 11*b* of the stationary scroll wrap. Because of the collision, breakage of the both scroll wraps may be caused or noises may be generated.

DISCLOSURE OF THE INVENTION

The present invention has been accomplished for solution of the problem described above, and has as an object to prevent the orbital scroll from collision against the terminal end of the stationary scroll on the side of the suction chamber.

The invention as a further object to prevent the orbital scroll from collision against the terminal end 11*b* of the stationary scroll.

In order to achieve the aforesaid objects, the invention provides an escape or recess in the stationary scroll wrap in the vicinity of the terminal end thereof on the side of the suction chamber.

Further, the invention provides an escape or recess in the orbital scroll wrap in the vicinity of a terminal end thereof.

BEST MODE FOR CARRYING OUT THE INVENTION

Figure 1:
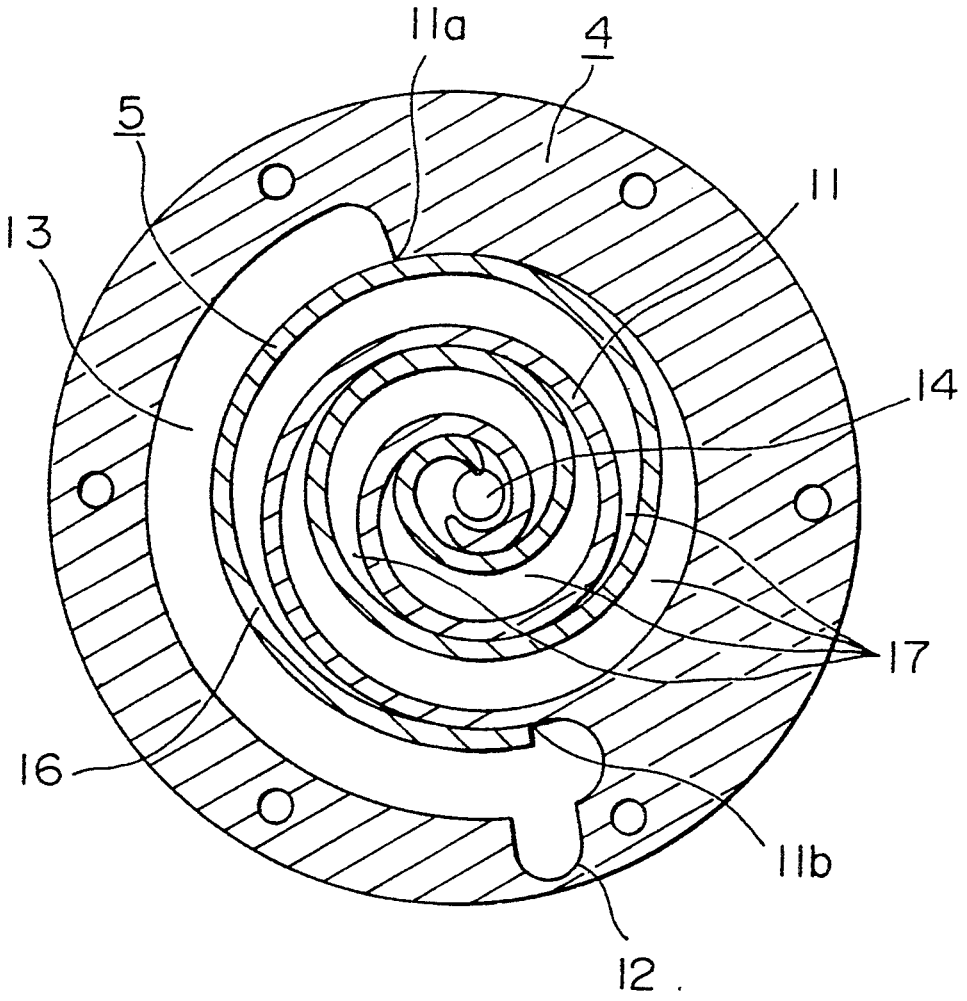
FIG. 1 PRIOR ART
FIG. 1 is a cross sectional view of the scroll wraps of a conventional scroll compressor.
Figure 2:
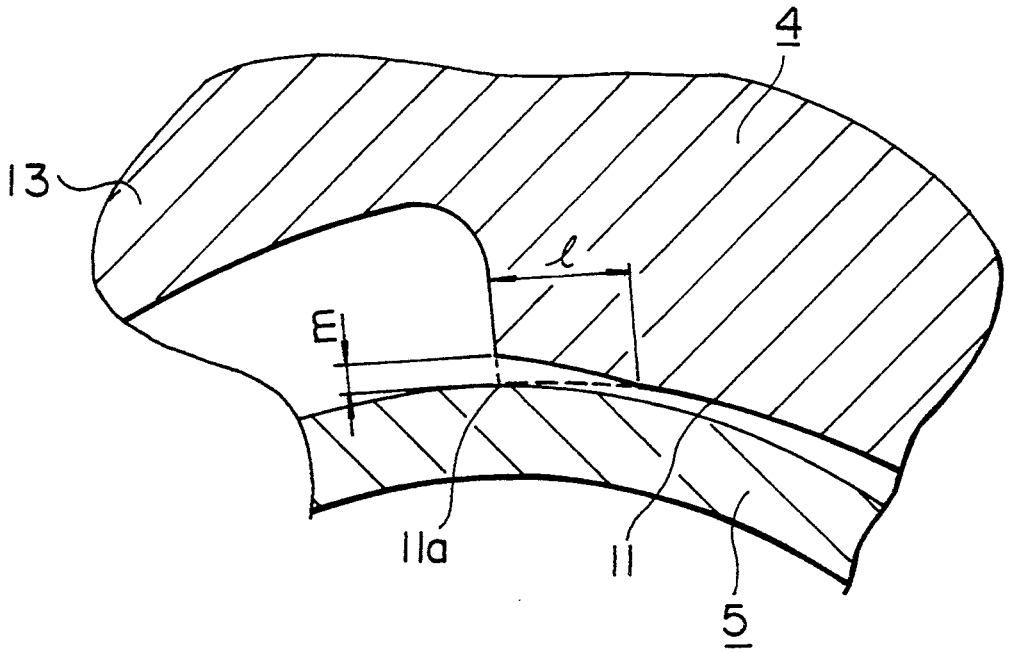
FIG. 2 is a view of a scroll wrap end and its vicinity in a first embodiment of the invention.
Figure 3:
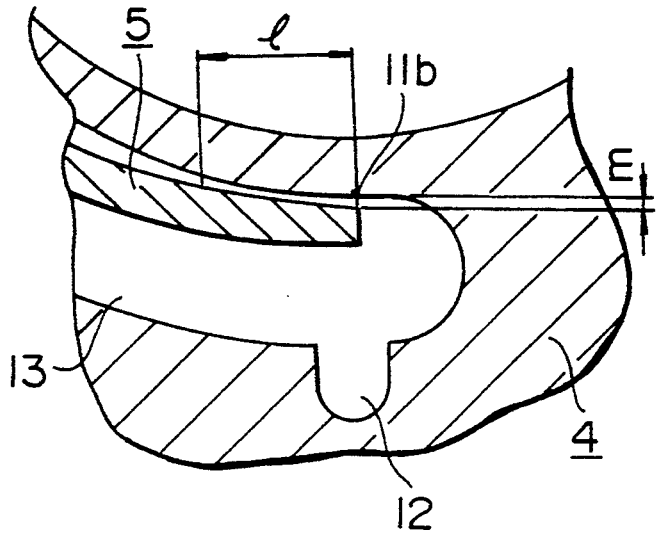
FIG. 3 is a view of a scroll wrap end and its vicinity in a second embodiment of the invention.
Figure 4:
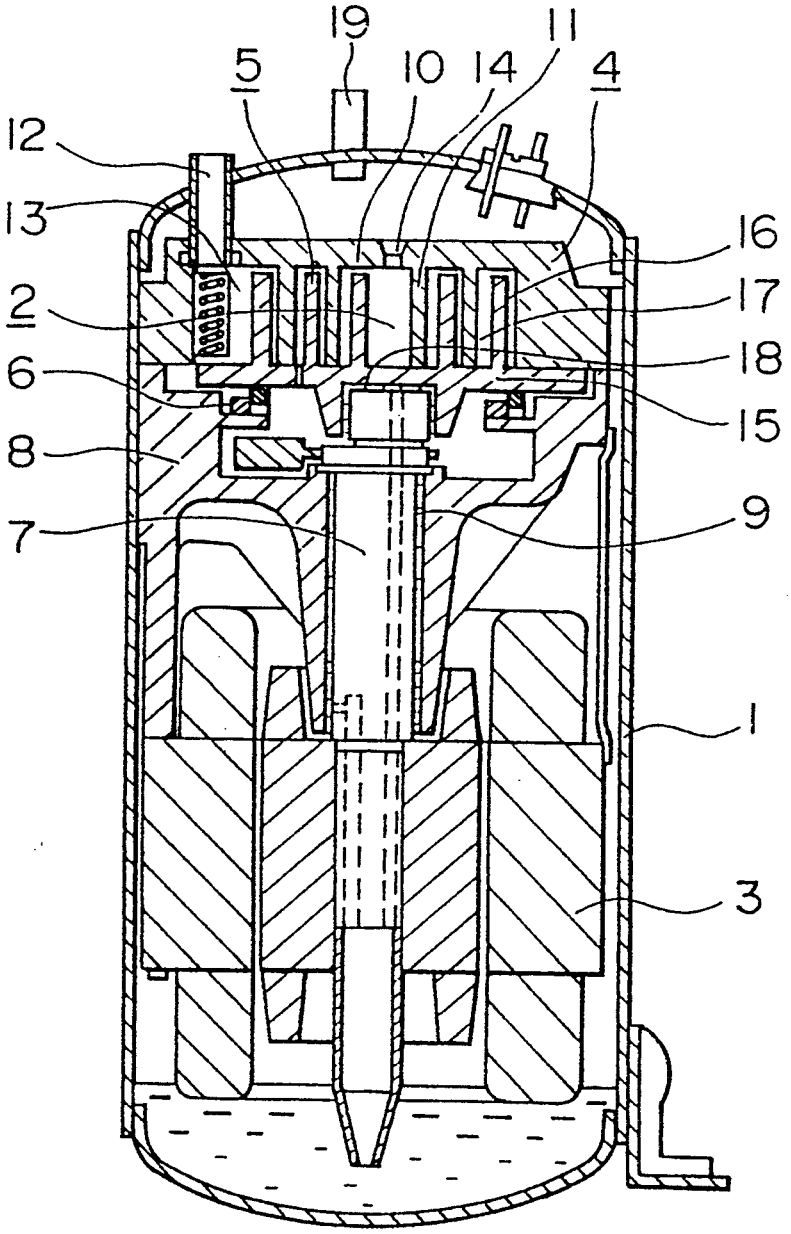
FIG. 4 PRIOR ART
FIG. 4 is a vertical sectional view of a conventional scroll compressor.

Preferred embodiments of the invention will be described hereinafter with reference to the drawings. Because the essential structure and function of each embodiment are similar to those of the conventional example shown in FIGS. 1 and 4, explanation thereof will be omitted. Referring to FIG. 2, the first embodiment of the invention will be described. FIG. 2 is illustrative of both scroll wraps when compression is started, and it is an enlarged view of the vicinity of 11*a* in FIG. 1, wherein a dotted line indicates the configuration of the stationary scroll 4 before the present invention is applied. More specifically, as shown in FIG. 2, an escape or recess defined by an arc or line is provided in the wrap of the stationary scroll in the vicinity of the terminal end thereof on the side of the suction chamber. A length l of the recess may be as long as a radius of the orbiting movement. A depth m of the recess may be, at the maximum, as deep as the sum total of a clearance between the bearing and the crank shaft and a clearance between the boss portion and the crank shaft. With the provision of this recess, the orbital scroll can gradually come into contact with the wrap of the stationary scroll without colliding against the terminal end 11*a* thereof, so that breakage of both wraps and occurrence of noises can be prevented. Subsequently, with reference to FIG. 3, the second embodiment of the invention will be described. FIG. 3 shows both scroll wraps when compression is started, and it is an enlarged view of the vicinity of 11*b* in FIG. 1. An arcuate or linear escape or recess is provided in the wrap of the orbital scroll near a terminal end thereof. A length l of the recess may be as long as the radius of orbiting movement of the orbital scroll. A depth m of the recess may be, at the maximum, as deep as the sum total of a clearance between the bearing and the crank shaft and a clearance between the boss portion and the crank shaft. With the provision of the recess, the orbital scroll can gradually be brought into contact with the wrap of the stationary scroll without colliding against the terminal end 11*b*, thereby avoiding breakage of both wraps and occurrence of noises. With the above structure, in addition to the effect that there happens no collision at the terminal end 11*a* of the stationary scroll wrap, collision at the terminal end 11*b* can also be avoided so that a possibility of breakage of both wraps and occurrence of noises is further reduced.

INDUSTRIAL APPLICABILITY

As apparent from the above-described embodiments, since the recess is provided in the vicinity of each terminal end of the stationary scroll wrap, collision of the orbital scroll wrap against the stationary scroll wrap can be avoided, whereby a scroll compressor having a high durability and reliability and making few noises can be realized.

We claim:

1. A scroll compressor comprising:

a stationary scroll having a stationary end plate and a stationary scroll wrap;

an orbital scroll having an orbital end plate and an orbital scroll wrap, the orbital scroll wrap being swingably and rotatably meshed with the stationary scroll wrap to form a plurality of scroll-shaped compression spaces;

a discharge port on a central portion of one of the stationary scroll and the orbital scroll; and a suction chamber outside an outer periphery of the stationary scroll wrap;

the stationary scroll wrap being displaced at a starting position of the stationary scroll for defining one of said plurality of scroll-shaped compression spaces near the outer periphery of the stationary scroll wrap, wherein the stationary scroll wrap is displaced at the starting position of the stationary scroll by way of a recess formed on a surface of the stationary scroll wrap at the starting position of the stationary scroll wrap, said scroll compressor further comprising a crank shaft which undergoes rotary motion, a bearing for supporting the crank shaft for the rotary motion, and a boss formed on the orbital scroll for transmitting the rotary motion of the crank shaft to the orbital scroll, wherein the recess of the stationary scroll wrap has a depth equal to a sum of a clearance between the crank shaft and the bearing and a clearance between the crank shaft and the boss.

2. A scroll compressor, comprising:

a stationary scroll having a stationary end plate and a stationary scroll wrap;

an orbital scroll having an orbital end plate and an orbital scroll wrap the orbital scroll wrap being swingably and rotatably meshed with the stationary scroll wrap to form a plurality of scroll-shaped compression spaces;

a discharge port on a central portion of one of the stationary scroll and the orbital scroll; and a suction chamber outside an outer periphery of the stationary scroll wrap;

the stationary scroll wrap being displaced at a starting position of the stationary scroll for defining one of said plurality of scroll-shaped compression spaces near the outer periphery of the stationary scroll wrap, the starting position being a position on the stationary scroll at which an outer periphery of the orbital scroll wrap would otherwise be in first contact with the stationary scroll wrap at a start of compression, wherein the stationary scroll wrap is displaced at the starting position of the stationary scroll by way of a recess formed on a surface of the stationary scroll wrap at the starting position of the stationary scroll wrap and the recess of the stationary scroll wrap has a linear surface.

3. A scroll compressor comprising:

a stationary scroll having a stationary end plate and a stationary scroll wrap;

an orbital scroll having an orbital end plate and an orbital scroll wrap, the orbital scroll wrap being swingably and rotatably meshed with the stationary scroll wrap to form a plurality of scroll-shaped compression spaces;

a discharge port on a central portion of one of the stationary scroll and the orbital scroll; and a suction chamber outside an outer periphery of the stationary scroll wrap.;

the stationary scroll wrap being displaced at a starting position of the stationary scroll for defining one of said plurality of scroll-shaped compression spaces near the outer periphery of the stationary scroll wrap, wherein the orbital scroll wrap has an inner peripheral side with a recess provided in the inner peripheral side near an end portion of the orbital scroll wrap on a side of the suction chamber, said scroll compressor further comprising a crank shaft which undergoes rotary motion, a bearing for supporting the crank shaft for the rotary motion, and a boss formed on the orbital scroll for transmitting the rotary motion of the crank shaft to the orbital scroll, wherein the recess of the orbital scroll wrap has a depth equal to a sum of a clearance between the crank shaft and the bearing and a clearance between the crank shaft and the boss.

* * * * *